US005171094A

United States Patent [19]

Kawamura

[11] Patent Number: 5,171,094

[45] Date of Patent: Dec. 15, 1992

[54] PRINTING APPARATUS HAVING HIGH IMPACT ERASING MECHANISM

[75] Inventor: Hiroki Kawamura, Aichi, Japan

[73] Assignee: Brother Kogyo Kabushiki Kaisha, Nagoya, Japan

[21] Appl. No.: 832,043

[22] Filed: Feb. 6, 1992

[30] Foreign Application Priority Data

Apr. 4, 1991 [JP] Japan ..... 3-100416

[51] Int. Cl.[5] ..... B41J 11/60

[52] U.S. Cl. ..... 400/697; 101/93.03; 310/14; 400/157.3

[58] Field of Search ..... 400/695, 696, 697, 144.2, 400/153.1, 153.3, 166, 185; 310/14; 101/93.03

[56] References Cited

U.S. PATENT DOCUMENTS 4,480,931 11/1984 Kamikura et al. ..... 400/697
4,558,965 12/1985 Ueda et al. ..... 101/93.03
4,569,607 2/1986 Takemoto ..... 400/157.3
4,806,030 2/1989 Quaranti et al. ..... 400/697
4,995,740 2/1991 Kubayashi ..... 400/695
5,024,545 6/1991 Yoshimoto et al. ..... 400/696
5,028,157 7/1991 Kikugawa ..... 400/696
5,066,150 11/1991 Babler et al. ..... 400/166

FOREIGN PATENT DOCUMENTS 0289134 2/1988 European Pat. Off. .

*Primary Examiner*—Eugene H. Eickholt
*Attorney, Agent, or Firm*—Oliff & Berridge

[57] ABSTRACT

Upon operation of an erasure key for erasing a printed character, a correction ribbon is moved in an erasure position according to rotation of a motor, and then, the motor is continuously rotated forward at a current I2 larger than a current I1 in a print operation. Therefore, a print hammer is accelerated to a speed V2 higher than a speed V1 in the print operation, to strike a platen at the speed V2. In the erasing operation, no pressing operation is performed after the stroke. Rather, the print hammer is immediately returned and the ink is removed.

16 Claims, 11 Drawing Sheets

PRINTING APPARATUS HAVING HIGH IMPACT ERASING MECHANISM

BACKGROUND OF THE INVENTION

1. Field of the Invention

The present invention relates to a character wheel type printing apparatus capable of erasing characters and, more particularly, to a printing apparatus where a speed of a print hammer in an erasing operation is higher than that in a print operation so as to improve removability of ink.

2. Description of Related Art

There has been conventionally known a character wheel type electronic typewriter capable of printing and erasing characters. These character wheel type electronic typewriters include a carriage having a print hammer, a character wheel, a print ribbon, a correction ribbon and drive mechanisms therefor.

In this type of electronic typewriter, individual motors drive a position shifting mechanism for shifting the position of a holder member having the print ribbon and the correction ribbon from a print position, where the print ribbon faces the print hammer in the print operation, to an erasure position, where the correction ribbon faces the print hammer in the erasing operation, a print hammer drive mechanism and a print ribbon taking-up mechanism, respectively.

The inventor of the present invention has proposed an electronic typewriter where only one motor disposed in a carriage unit drives the mechanism for shifting the position of the holder member, the print hammer drive mechanism, the print ribbon taking-up mechanism and a correction ribbon taking-up mechanism, so as to realize a reduced size of the carriage at a reduced manufacturing cost. Consequently, in the above-described electronic typewriter, a print cam for driving the print hammer is formed integrally with a lift cam for lifting the holder member up to the erasure position in a drive shaft of the motor, and the print hammer is driven via the print cam according to the forward rotation of the motor. The holder member is shifted in the erasure position via the lift cam according to the reverse rotation of the motor at a predetermined angle at the time of erasing characters, to allow the print hammer to erase the characters via the print cam according to the forward rotation.

Furthermore, in order to reduce strike noise caused by the print hammer in the print and erasing operations, it is effective to make a speed of the print hammer lower than an usual speed. For the purpose of compensating a smaller strike force due to the low speed, a platen must be pressed by the print hammer for a slight period after the stroke. Accordingly, although the strike noise of the print hammer will be reduced and the adhesiveness of ink will be enhanced, a recess of the character deeper than usual will be formed on print paper with application of a pressure of the print hammer in the print operation. In addition, the ink of the print ribbon will adhere to a portion around the recess because of the larger recess formed on the print paper.

In the electronic typewriter proposed by the inventor of the present invention as described above, the motor for driving the print hammer is controlled in an erasing operation in the same manner as in the print operation, with concomitant problems that the recess becomes much larger under pressure, that the ink adhering to the recess corresponding to the character can be removed while the ink adhering to the portion around the recess cannot be removed sufficiently, and so on.

SUMMARY OF THE PRESENT INVENTION

It is an object of the present invention to provide a printing apparatus capable of securely removing the ink without enlarging the recess formed on the print paper due to the stroke of the print hammer in the erasing operation.

A printing apparatus according to the present invention comprises: a carriage unit capable of laterally reciprocating along a platen, the carriage unit having a character wheel, a print hammer, a motor and a cam rotated by the motor; a print mechanism disposed in the carriage unit, for allowing the print hammer to strike the platen via the character of the character wheel and a print ribbon in association with the rotation of the cam; an erasing mechanism for interposing a correction ribbon between the character and the platen; and control means for rotating the motor at a first speed, the control means driving the motor in the same direction for a predetermined slight period after the striking operation of the print hammer on the platen upon reception of a print command, the control means rotating the motor at a second speed higher than the first speed after operating the erasing mechanism and bringing the motor to a halt at the time of the striking operation of the print hammer on the platen upon reception of an erasure command.

In the printing apparatus according to the present invention, the control means rotates the motor at the first speed and drives the motor in the same direction for the predetermined slight period after the striking operation of the print hammer on the platen upon reception of the print command so that the print hammer strikes the platen via the character of the character wheel and the print ribbon by means of the print mechanism. The print hammer presses the platen for a slight period after the striking operation. As a result, the strike noise becomes small, and a recess is formed on print paper under pressure of the print hammer. Ink of the print ribbon can sufficiently adhere to the recess and also to a portion around the recess with a good contact by the character.

Meanwhile, upon reception of the erasure command, the control means rotates the motor at the second speed higher than the first speed after the operation of the erasing mechanism, and then, brings the motor to a halt at the time of the striking operation of the print hammer on the platen. Although the erasing mechanism causes the print hammer to strike the platen via the character and the correction ribbon interposed therebetween, the movement of the print hammer is stopped immediately after its contact with the platen. As a result, the speed of the print hammer in the erasing operation is higher than that in the print operation, without any pressing operation so that the ink adhering to the recess can be securely removed without deepening the recess. Additionally, since the correction ribbon is generally thicker than the print ribbon and the speed of the print hammer is higher, the erasing operation is performed while the portion around the recess is outwardly enlarged. The ink adhering to the enlarged portion around the recess can be rubbed by the correction ribbon to be securely removed.

BRIEF DESCRIPTION OF THE DRAWINGS

The invention will be described in detail with reference to the following drawings, in which like reference numerals refer to like elements, and wherein.

DESCRIPTION OF THE PREFERRED EMBODIMENT

A printing apparatus of one preferred embodiment according to the present invention will be described hereinafter with reference to the drawings. The present invention is applied to an electronic typewriter where only one DC motor performs a combination print operation and a taking-up operation of a print ribbon and a combination erasing operation and a taking-up operation of a correction ribbon.

Figure 1:
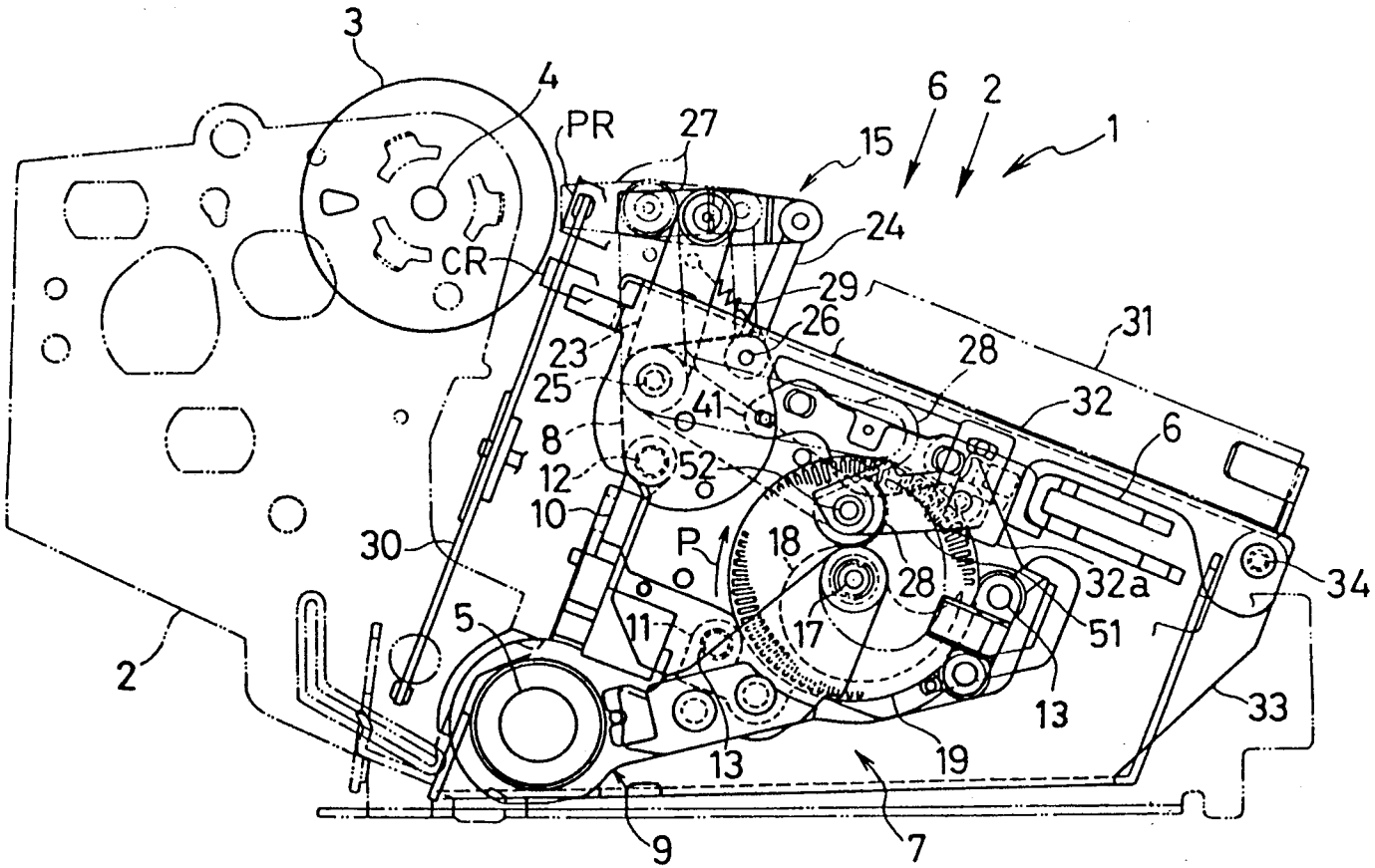
FIG. 1 is a side view of an inner mechanism of an electronic typewriter in one preferred embodiment according to the present invention.
Figure 2:
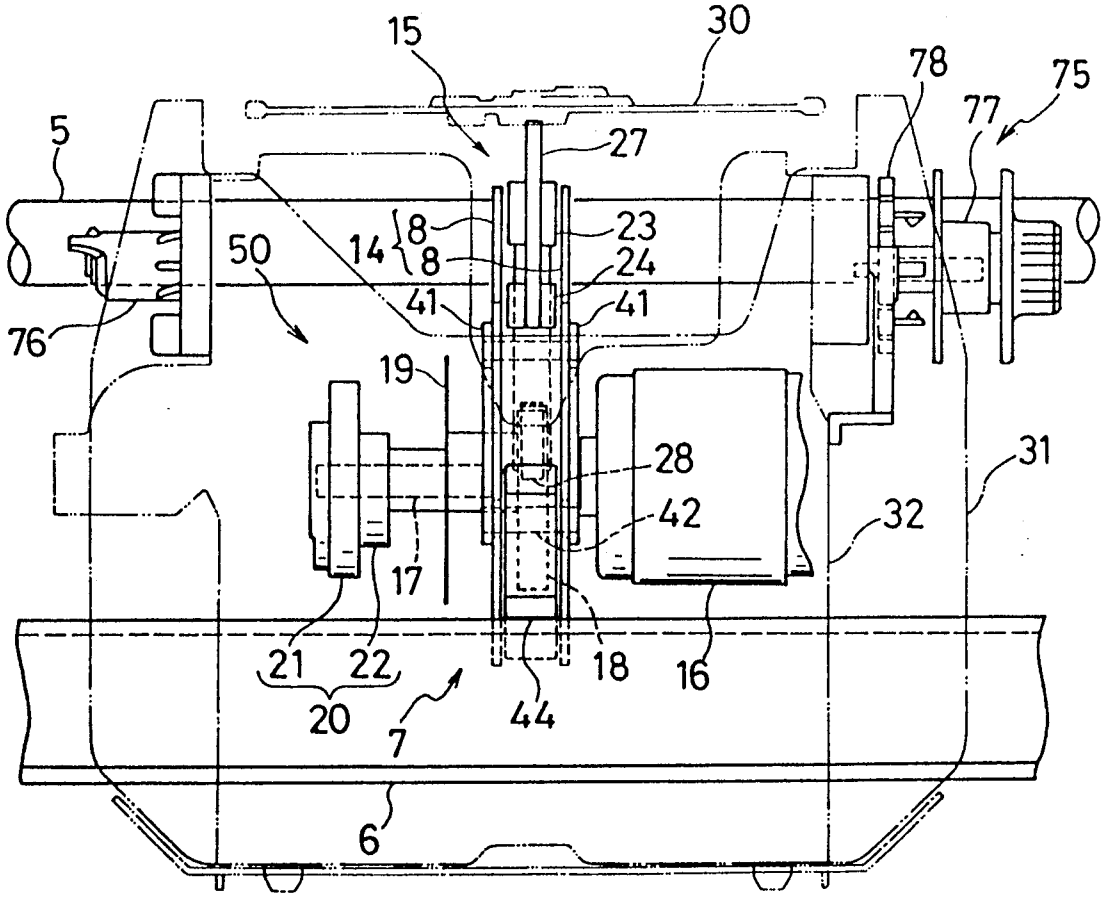
FIG. 2 is a view showing a part of the inner mechanism of the electronic typewriter viewed from the direction indicated by an arrow 2 of FIG. 1.

As shown in FIGS. 1 and 2, a pair of side walls 2 are disposed at right and left ends inside of a casing of a typewriter 1. A platen 3 interposed between the side walls 2 is rotatably supported on the side walls 2 in the vicinity of both ends of a platen shaft 4, and rotatably driven via a driven gear fixed to the left end of the platen shaft 4 by a platen drive mechanism having a line feed motor 39 driven by a drive circuit 84 (see FIG. 10).

Between the pair of side walls 2, a guide shaft 5 and a guide member 6 having an almost U shape viewed sideways are arranged parallel to the platen 3. A carriage 7 movably supported in the lateral direction by the guide shaft 5 and the guide member 6 will be explained referring to FIGS. 1 through 5.

Two plate-type main frames 8 spaced at a predetermined distance in the lateral direction and each having a substantial rectangular shape are arranged lengthwise between the guide shaft 5 and the guide member 6. The main frames 8 serve as the upper ends of first and second supporters 10, 11 of a support member 9 laterally movably and rotatably supported by the guide shaft 5, and are fixed outward by pins 12, 13 at the upper ends of the supporters 10, 11 as spacers inserted between the main frames 8. The two main frames 8 comprise a carriage unit 14.

Next, a print mechanism 15 will be described hereunder. A DC motor 16 is supported in the right main frame 8 in such a state as to prevent its own rotation. The drive shaft 17 of the motor 16 extends leftward through the main frames 8. There are provided in the drive shaft 17, in order from the motor 16 side of drive shaft 17, a print cam 18 having a substantial whirl shape viewed sideways and located inside of the main frames 8, an encoder disk 19 for detecting a rotational speed of the motor 16, a ribbon supply cam 22 for feeding a print ribbon PR stepwise, and a lift cam 21 for lifting a holder member 32 to an erasure position. A cam unit 20 is comprised of the print cam 18, the ribbon supply cam 22 and the lift cam 21, wherein the ribbon supply cam 22 is formed integrally with the lift cam 21 as the cam unit. The print start position of the print cam 18 is indicated by a dotted line in FIG. 1; and the original set position thereof, by a two-dot chain line.

Figure 4:
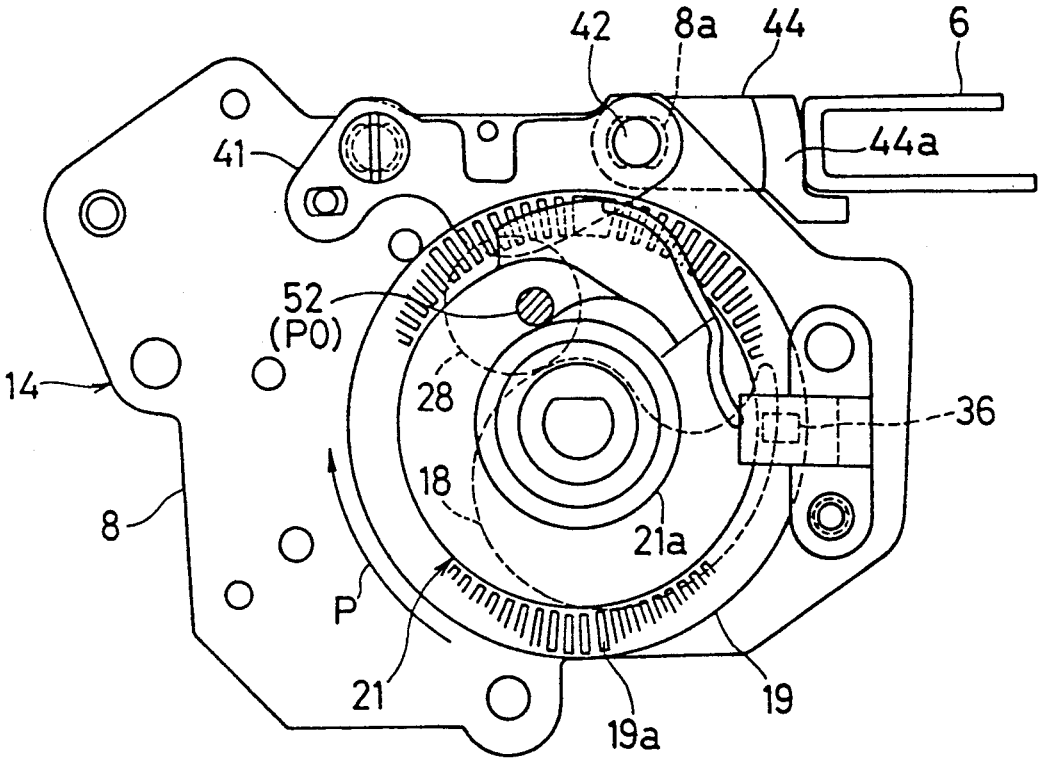
FIG. 4 is a side view of a main frame.
Figure 5:
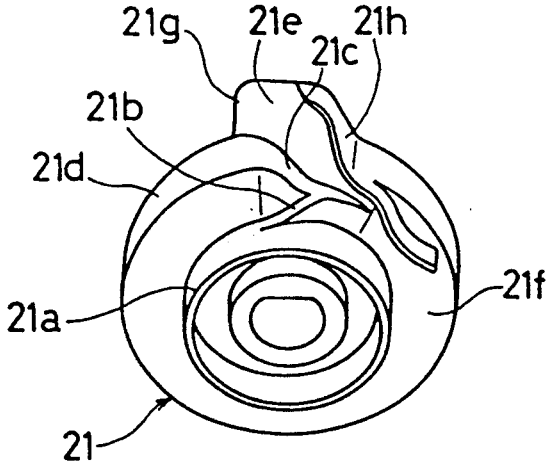
FIG. 5 is a perspective view of a lift cam.

As illustrated in FIG. 4, a plurality of slits **19*a* are formed in a circle at intervals of the same dimension as the width of the slit around the encoder disk 19. A photo sensor 36 for detecting the plurality of slits 19*a* is attached to the left main frame 8. Namely, the photo sensor 36 inputs a slit signal in response to detection of slit edges into the input/output interface 85 of a controller C shown in FIG. 10 every time each edge of the slits 19*a* is moved according to the rotation of the encoder disk 19**.

Above the rear end of the main frame 8 are rotatably supported the central portion of a turn lever 23 having an almost V-shaped cross section and the lower end of a link 24 by pins 25, 26, respectively. A print hammer 27 disposed opposite to the platen 3 in the lengthwise direction is rotatably pivoted at the lower end thereof on the upper end of the link 24, and at the central portion thereof in the lengthwise direction on the upper end of the turn lever 23. Furthermore, at the fore end of the turn lever 23 is rotatably supported a cam follower 28, and a tension spring 29 is stretched across the upper end of the turn lever 23 and the lower end of the link 24 in such a manner that the cam follower 28 is kept to abut against the surface of the print cam 18. There are shown a daisy wheel 30 rotatably driven by a wheel drive mechanism including a wheel drive motor 37 driven by a drive circuit 82 (see FIG. 10); a ribbon cassette 31 containing the print ribbon PR therein; and a holder member 32 having the ribbon cassette 31 mounted thereon, and capable of vertically oscillating on an auxiliary frame 33 laterally movably supported on the guide shaft 5 via a support shaft 34. The carriage 7 is laterally reciprocated along the platen 3 through a drive wire by a drive mechanism including a carriage drive motor 38 driven by a drive circuit 83 (see FIG. 10).

As depicted in FIG. 4, the outer curved surface of the print cam 18 has a large radius enlarging ratio in the fore half within the slide range of the cam follower 28, and a minute ratio in the rear half including a strike portion where the cam follower 28 slides when the print hammer 27 strikes the platen 3. In addition, the curved cam of the print cam 18 extends by a predetermined length from the slide range in such a manner as to prevent the cam follower 28 from being disengaged from the cam surface after the stroke of the print hammer 27.

Figure 13:
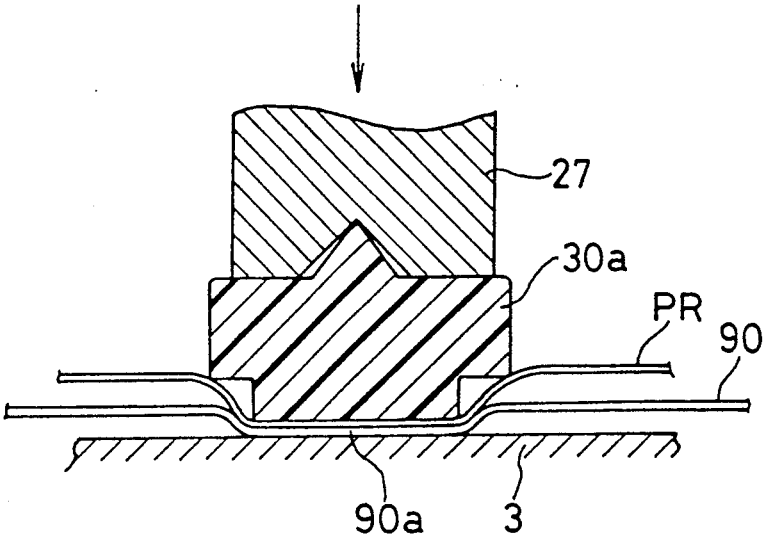
FIG. 13 is a partially enlarged sectional view of the principle parts, showing a print operation.

Accordingly, since the cam follower 28 is lifted along the cam surface of the print cam 18 upon the rotation of the motor 16 at a high speed by a given angle in the print direction P from the print start position in FIG. 1, the turn lever 23 is turned counterclockwise and the print hammer 27 strikes the platen 3 via a character 30*a* of the daisy wheel 30 and the print ribbon PR (see FIG. 13).

Adjustment plates 41 extending lengthwise are disposed outside at the upper ends of the main frames 8, respectively. At the fore ends of the adjustment plates 41 is fixed a support shaft 42 inserted into slots 8*a* formed in the main frames 8. Moreover, an engagement portion 44*a* slidably engaging the rear end of the guide member 6 is disposed at the fore end of an abutment member 44 where the rear end of the support shaft 42 is rotatably supported.

Referring to FIGS. 1 through 5, an erasing mechanism 50 will be described hereinafter, which lifts the holder member 32 from the print position up to the erasure position where a correction ribbon CR faces the print hammer 27 in place of the print ribbon PR in the character erasing operation.

The lift cam 21 is formed integrally with the ribbon supply cam 22 as the cam unit. The lift cam 21 formed on the left side of the cam unit comprises: a reference cam 21*a* having a uniform radius from the center of the cam 21; a first inclined cam face 21*b* extending, in the radius enlarging direction, continuously from the reference cam 21*a;* a second inclined cam face 21*c* extending continuously from the first inclined cam face 21*b* to an outer cam face 21*d;* a thin guide wall 21*e* extending in the radius enlarging direction from the right end of the second inclined cam face 21*c*, the thickness of which is reduced from a left end face 21*f* of the cam 21 shown in FIG. 2 toward a thin left end 21*g* of the guide wall 21*e;* and a guide rib 21*h* projecting from the guide wall 21*e* toward the left end 21*f* along the outer periphery of the guide wall 21*e*, and extending from the guide wall 21*e* toward the left end 21*f* in the radius reducing direction.

Furthermore, a driven pin 52 abutting against the lift cam 21 is laterally movably supported at the lower end of a support member 51 fixed at the upper end thereof to a side wall 32*a* at the left end of the holder member 32, to be resiliently urged rightward by a coil spring 53 at all times. The driven pin 52 allows the tip of the pin thereof to abut downward against the reference cam 21*a* by the dead load of the holder member 32 at the time of print start as illustrated in FIG. 4, to support the holder member 32 in the print position (reference oscillation position) and abut leftward against the left end 21*f* as depicted in FIG. 1. Namely, the vertical oscillation of the holder member 32 is determined by the vertical movement of the driven pin 52. FIG. 4 shows the positional relationship among the print cam 18, the lift cam 21 and the driven pin 52 at the time of print start.

Consequently, when the cam unit 20 is rotated by a predetermined angle from a phase angle in the direction reverse to the print direction P (hereinafter referred to as "the reverse print direction") by the motor 16 at the time of print start as shown in FIG. 4, the driven pin 52 is moved upwardly by the first inclined cam face 21*b* so that the holder member 32 is also oscillated upwardly according to the distance of the upward movement. The driven pin 52 then reaches the outer cam face 21*d* via the second inclined cam face 21*c* upon the rotation of the cam unit 20 in the print direction P so that the holder member 32 is oscillated further upwardly in the erasure position. At this moment, the correction ribbon CR faces the print hammer 27.

Figure 3:
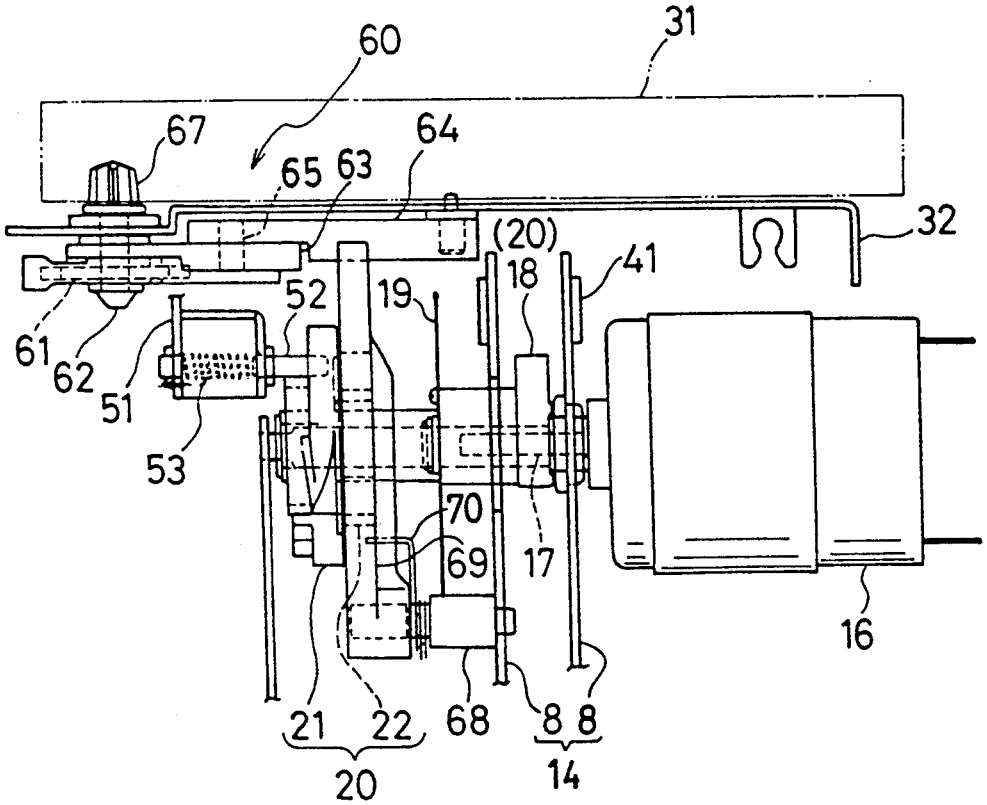
FIG. 3 is a partially front view of the inner mechanism of the electronic typewriter.

Next, a print ribbon taking-up mechanism 60 for taking up the print ribbon PR by a predetermined length in a taking-up spool in the print operation will be explained with reference to FIGS. 3, 6 and 7.

At the left end under the holder member 32 is rotatably supported a ratchet 61 having a plurality of teeth by a pin 62. A third oscillating member 63 rotatably supported by the pin 62 and having a feed pawl 63*a* is connected to a second oscillating member 64 rotatably supported in the holder member 32 through a connecting pin 65. The second oscillating member 64 is resiliently urged counterclockwise in FIG. 6 by a tension spring 66. A taking-up spool 67 is secured to the pin 62. Meanwhile, a first oscillating member 69 is rotatably supported at the lower end thereof on a support pin 68 fixed in the left main frame 8 in the position of the ribbon supply cam 22 having a whirl shape. The upper end of the first oscillating member 69 abuts against the second oscillating member 64 in the vicinity of the base end thereof. Furthermore, the ribbon supply cam 22 is positioned in an almost circular hole 69*a* formed in the first oscillating member 69. The first oscillating member 69 is resiliently urged clockwise in FIG. 7 by a taking-up spring 70 wound around the support pin 68 in such a manner that a projection 69*b* of the first oscillating member 69 is held to abut against a part of the ribbon supply cam 22.

Figure 6:
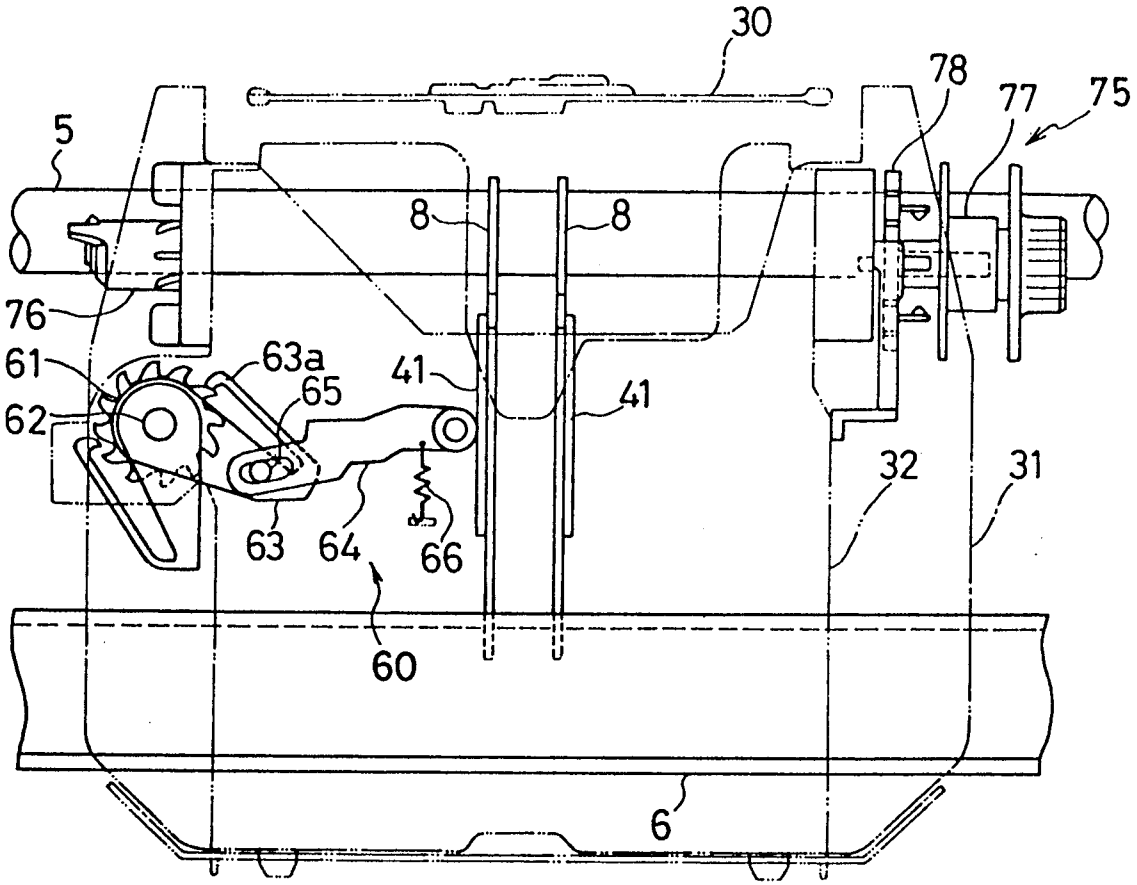
FIG. 6 is a view showing a part of the inner mechanism of the electronic typewriter viewed from the direction indicated by an arrow 6 of FIG. 1.
Figure 7:
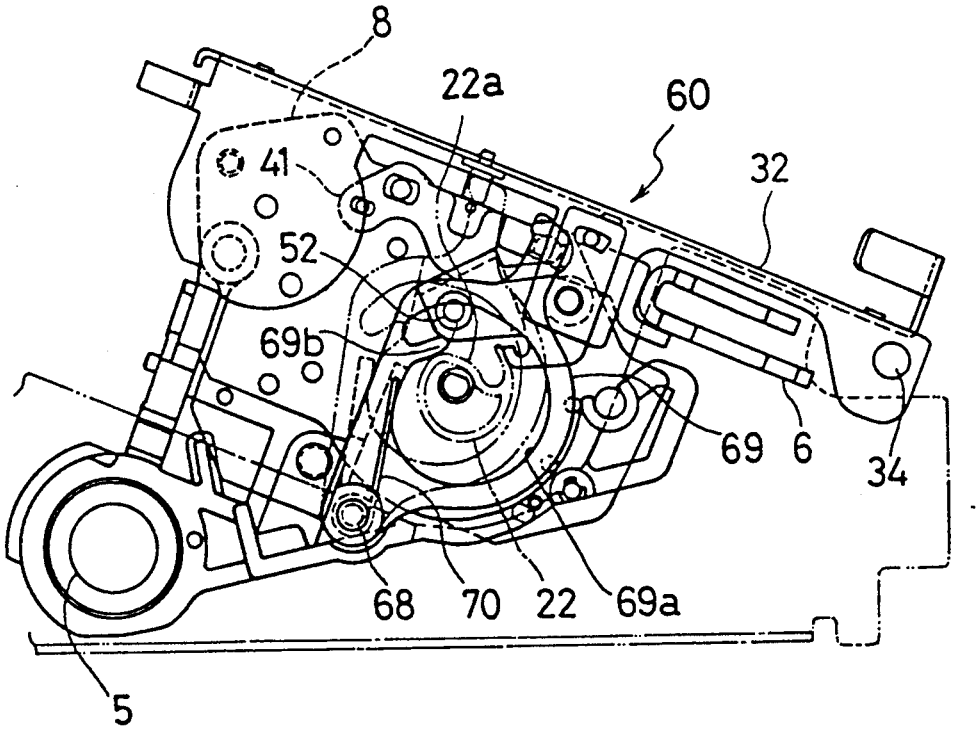
FIG. 7 is a side view of principle parts of the inner mechanism.

As a result, when the ribbon supply cam 22 is rotated in the print direction P by the motor 16, the first oscillating member 69 is turned counterclockwise in FIG. 7 via the projection 69*b* by the effect of the shape of the ribbon supply cam 22 so that the second oscillating member 64 is turned clockwise while the third oscillating member 63 is turned counterclockwise in FIG. 6, the ratchet 61 is turned by one tooth by the feed pawl 63*a*, and consequently, the print ribbon PR can be fed by a preset step by the taking-up spool 67 before the print operation.

Subsequently, a correction ribbon taking-up mechanism 75 for taking up the correction ribbon CR by a given length in a taking-up spool in the erasing operation will be briefly explained hereunder with reference to FIGS. 2 and 6. At the side wall 32*a* at the rear end of the holder member 32 is rotatably supported a supply spool 76 of the correction ribbon CR, and at the right end thereof is rotatably supported a taking-up spool 77 for taking up the correction ribbon CR. A ratchet 78 having a plurality of teeth is attached to the taking-up spool 77. Behind the ratchet 78, a feed pawl 79 (see FIG. 8) for rotating the ratchet 78 in one tooth increments is erected on the auxiliary frame 33.

Namely, in the same manner as the erasing mechanism 50, if the phase angle of the cam unit 20 at the time of the print start is 0°, the cam unit 20 is rotated by about 55° from the phase angle 0° (see FIG. 8) in the reverse print direction (hereinafter referred to as a phase angle −55°) so that the driven pin 52 is moved upward along the first inclined cam face 21*b* to be positioned on the second inclined cam face 21*c*.

Figure 8:
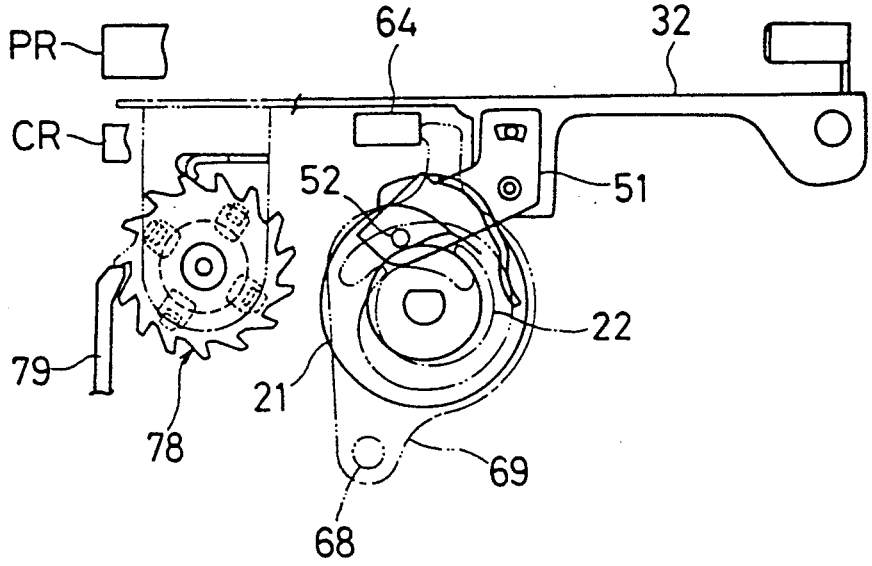
FIG. 8 is a side view of principle parts of the inner mechanism at a print start position.
Figure 9:
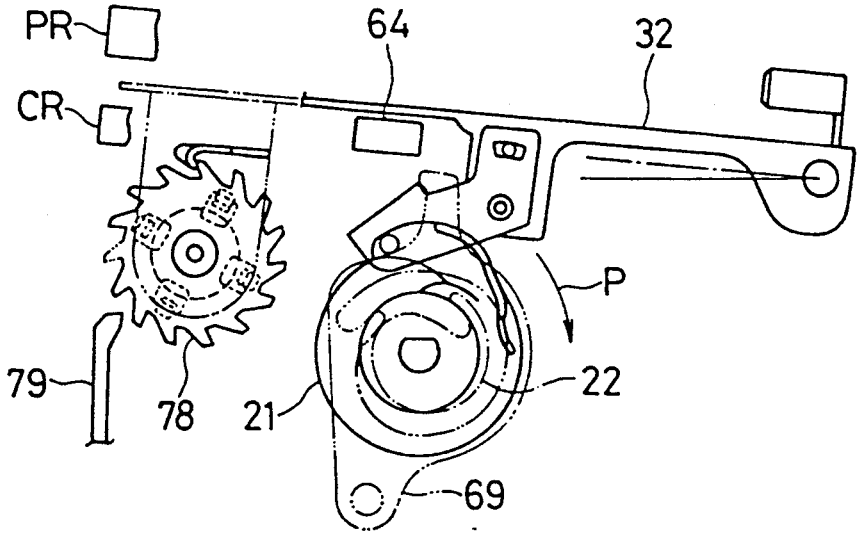
FIG. 9 is a view showing a holder member in an erasure position, corresponding to FIG. 8.

Additionally, when the cam unit 20 is rotated in the print direction P from −55° to 0°, the driven pin 52 is moved above the second inclined cam face 21*c* to reach the outer cam face 21*d* (see FIG. 9). Namely, at this time, the holder member 32 is shifted to the erasure position where the correction ribbon CR faces the print hammer 27. When the cam unit 20 is rotated −90° in the reverse print direction after the cam unit 20 is rotated in the print direction P from 0° to perform the erasing operation, the driven pin 52 is reversely moved from the outer cam face 21*d* to the second inclined cam face 21*c* to reach the reference cam 21*a*, and the holder member 32 descends down to the original print position. At the time of the descent of the holder member 32, the ratchet 78 is rotated by one tooth by the feed pawl 79 so that the correction ribbon CR is fed by a step. In FIGS. 8 and 9, the lift cam 21 is shown by a solid line; the ribbon supply cam 22, by a dashed line; and the first oscillating member 69, by a two-dot chain line.

Figure 10:
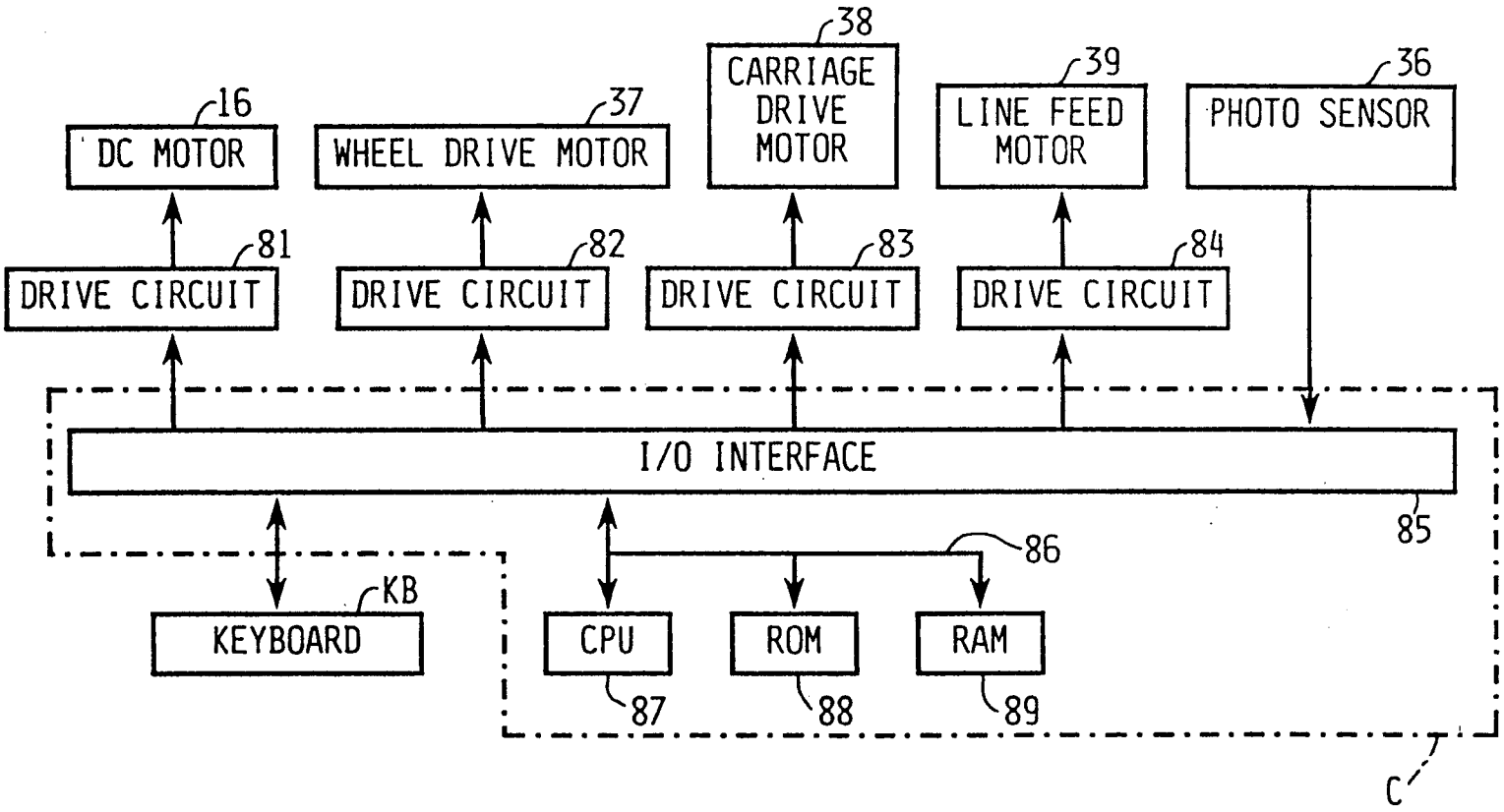
FIG. 10 is a block diagram of a control system of a printing apparatus.

The control system of the electronic typewriter 1 is as depicted in the block diagram in FIG. 10.

The rotational speed of motor 16 can be changed by PWM (pulse width modulation) control. Namely, the controller C determines a ratio of a time, i.e., a duty ratio, when a drive current is supplied to the motor 16 within a predetermined period, to obtain a preset rotational speed by using a slit signal output from the photo sensor 36. A pulse signal of the duty ratio is supplied to a drive circuit 81 to input a drive current in response to the pulse signal to the motor 16.

The controller C comprises a CPU 87, the input/output (I/O) interface 85 connected to the CPU 87 via a bus 86 such as a data bus, a ROM 88 and a RAM 89. The ROM 88 stores therein a drive control program for driving the motor 16 to perform a print or erasing operation, another drive control program for driving the motors 37 through 39 in association with the print or erasing operation. The RAM 89 contains therein a buffer for temporarily storing data required for controlling the typewriter 1 and a calculated result of the CPU 87, a counter for counting the slit signals output in sequence from the original set position, a pointer and various memories.

The character print and erasing operations will be explained hereinafter with reference to FIGS. 11 through 16.

Figure 11:
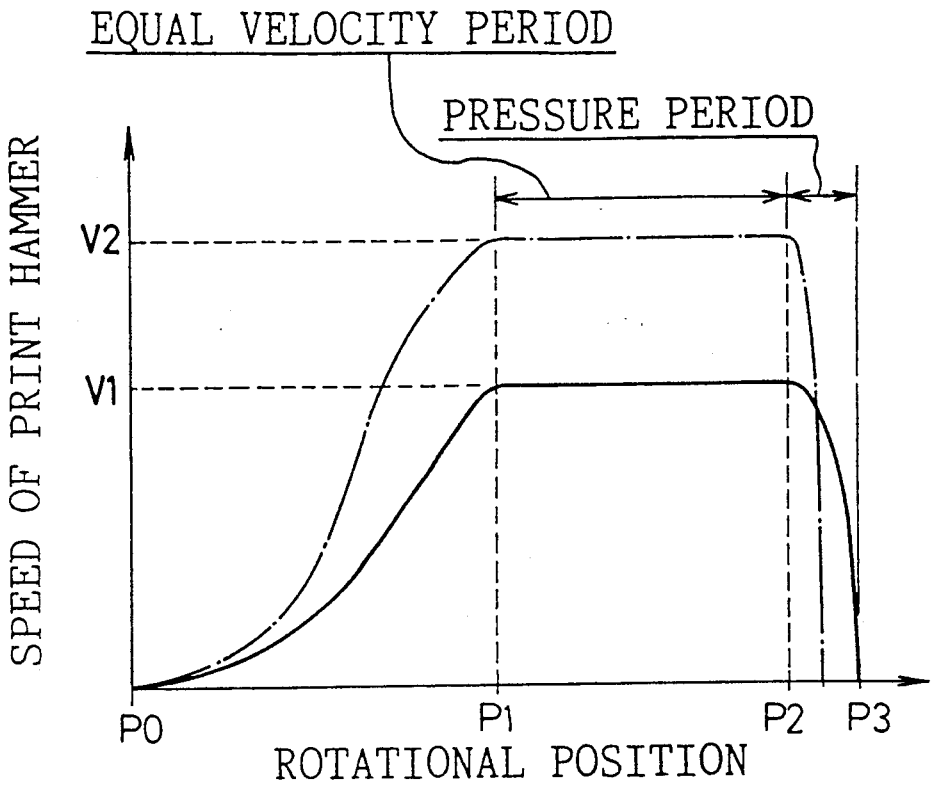
FIG. 11 is a graph of speeds of a print hammer in the print and erasing operations.
Figure 12:
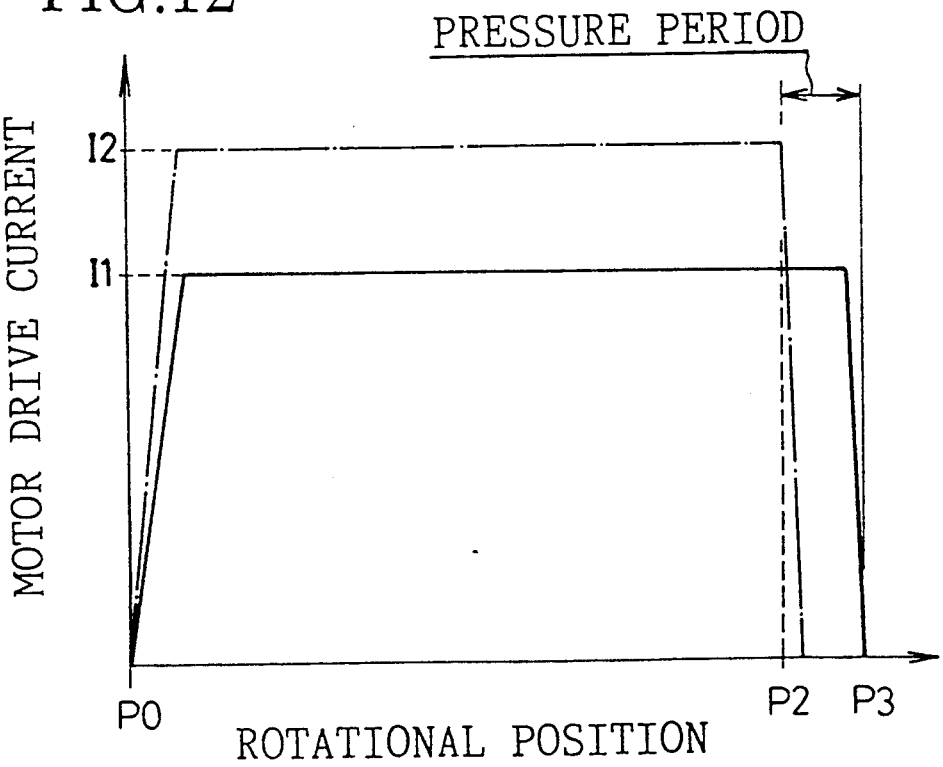
FIG. 12 is a graph of motor drive currents in the print and erasing operations.

As depicted by solid lines in FIGS. 11 and 12, when the print cam 18 reaches a rotational position P0 where the print hammer 27 starts the movement for printing a character after a character key operation by means of a keyboard KB, the motor 16 is continuously rotated forwardly while controlling the duty ratio in such a manner that the rotational speed of the print cam 18 becomes a rotational speed, at which the slit signals are input every 0.3 msec. Accordingly, since the motor 16 is driven at a drive current of almost I1 immediately after the rotational position P0 of the print cam 18, a speed of the movement of the print hammer 27 (hereinafter referred to as "a speed of the print hammer") is accelerated to a speed in a rotational position P1 of the print cam 18 according to the shape of the print cam 18, and is kept at a predetermined equal speed V1 after the rotational position P1. The motor 16 is brought to a halt in a rotational position P3 after an elapse of a short period of time since the print hammer 27 strikes the platen 3 via the character 30*a* of the daisy wheel 30 and the print ribbon PR reaches a rotational position P2. In this case, the speed of the motor 16 is controlled such that the speed V1 of the print hammer in the print operation becomes lower than a usual speed of the print hammer, thus reducing the strike noise in the print operation. The CPU 87 controls the motor 16 to drive the print cam 18 while comparing a count of the slit signals counted by the counter of the RAM 89 with a reference count previously stored.

Figure 14:
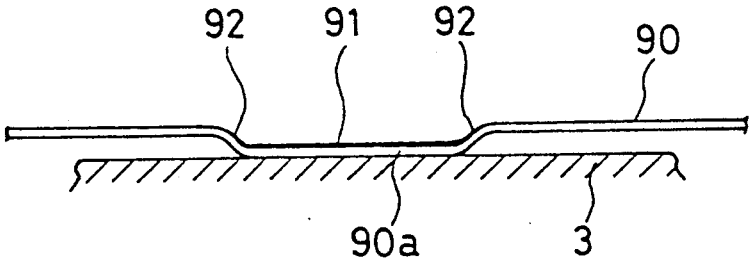
FIG. 14 is a partially enlarged sectional view of the principle parts, showing a printed state of print paper.

In other words, the print hammer 27 strikes the platen 3 via the character 30*a* and the print ribbon PR in the rotational position P2. The shape of the print cam 18 at the time of striking has a fine radius enlarging ratio of the cam face. Accordingly, as shown in FIG. 13, the print hammer 27 strikes the platen 3 for a short period from the rotational position P2 to the rotational position P3 so that a recess 90*a* is formed on print paper 90 with application of a pressure of the print hammer 27 as illustrated in FIG. 14. Ink 91 of the print ribbon PR adheres to the recess 90*a* and ink 92 adheres to a portion (an inclined portion) around the recess 90*a* in a state scrubbed by the character 30*a*. Strike energy reduced due to the speed V1 lower than usual is compensated by the pressing operation. In a general typewriter, the print operation can be performed utilizing an impact obtained by kinetic energy of the print hammer 27, while in the electronic typewriter in this embodiment, the print operation can be performed using energy generated by the impact and pressure energy of the print hammer 27.

Subsequently, as shown by the dashed lines in FIGS. 11 and 12, the motor 16 is rotated in the print direction or reverse print direction and the holder member 32 is shifted to the erasure position upon the operation of an erasure key (see FIG. 9). The print cam 18 then reaches the rotational position P0 where the print hammer 27 starts its movement for the character erasing operation. The motor 16 is continuously rotated forwardly while controlling the duty ratio in such a manner that the rotational speed of the print cam 18 becomes a rotational speed at which the slit signals are input every 0.2 msec. As a result, the motor 16 is driven at a drive current of almost I2 immediately after the rotational position P0 of the print cam 18 so that the speed of the print hammer is accelerated until the print cam 18 is rotated up to the rotational position P1, and is maintained at a speed higher than that in the print operation, i.e., a predetermined equal speed V2 after the rotational position P1. The motor 16 is brought to a halt at the rotational position P2 of the print cam 18 where the print hammer 27 strikes the platen 3 via the character 30*a* of the daisy wheel 30 and the correction ribbon CR.

Figure 15:
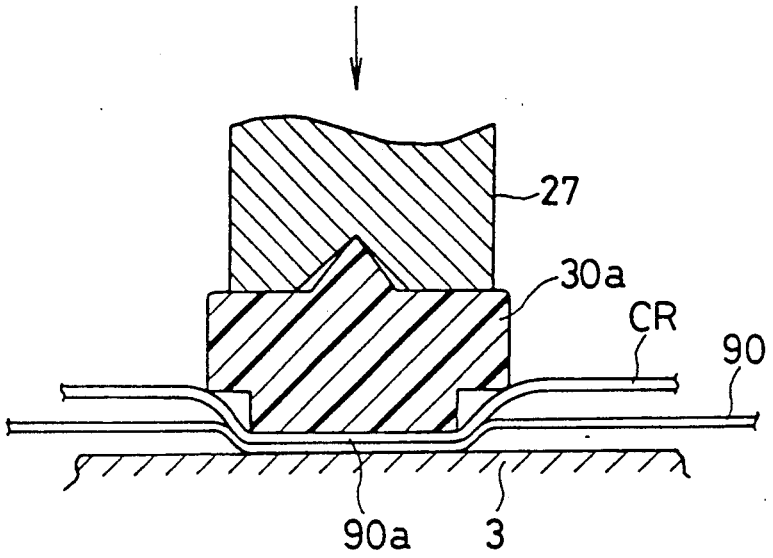
FIG. 15 shows an erasing operation, corresponding to FIG. 13.
Figure 16:
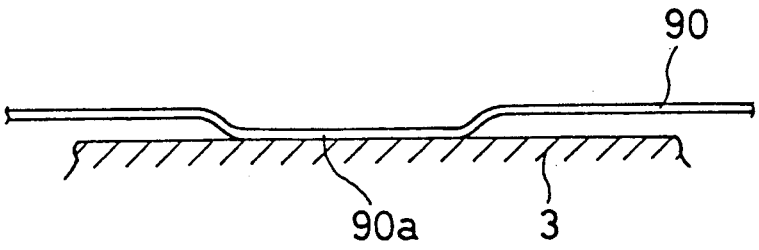
FIG. 16 shows an erased state of the print paper, corresponding to FIG. 14.

Namely, as depicted in FIG. 15, the print hammer 27 strikes the platen 3 via the character 30*a* and the correction ribbon CR in the rotational position P2 of the print cam 18, and is brought to a halt immediately after the rotational position P2 where the print hammer 27 strikes the platen 3. Accordingly, the speed of the print hammer in the erasing operation is higher than that in the print operation, without any pressing operation. Moreover, as shown in FIG. 16, the ink 91 adhering to the recess 90*a* can be securely removed without deepening the recess 90*a*.

The correction ribbon CR is generally thicker than the print ribbon PR and the speed of the print hammer is higher in the erasing operation. Consequently, the erasing operation can be performed while enlarging outwardly the portion around the recess 90*a*, and the ink 92 adhering to the enlarged portion can be securely removed by the correction ribbon CR. Namely, the print hammer 27 performs the strike operation with the large kinetic energy applied thereto, to promote the adhesiveness between the correction ribbon CR and the ink 91, and further, the correction ribbon CR scrubs the ink 91 at the high speed to promote the removal of the ink 92.

The motor 16 is reversely rotated for every operation of the print hammer 27 in the print or erasing operation, and the print cam 18 and the print hammer 27 return to the original position, respectively.

If the speed of the print hammer is varied according to a character to be printed in the print operation, the speed of the print hammer in the erasing operation may be accelerated about 20-50% of that in the print operation. The cam unit 20 may be indirectly rotated via a gear mechanism by means of the motor 16. Other various embodiments where the holder member 32 is shifted to the erasure position upon the operation of the erasure key can be used for the erasing mechanism 50.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A printing apparatus for applying an impact between a character and a print medium in response to an input command for one of printing the character and erasing a printed character, comprising:

selecting means for selecting a character to be printed;

a print ribbon for transferring ink onto the print medium in a shape corresponding to the character by application of an impact by the character selected by said selecting means;

a correction ribbon for removing, from the print medium, ink transferred onto the print medium;

a hammer which is driven to apply the impact between the character and the print medium;

an association mechanism;

a cam unit including hammer driving means for driving said hammer via said association mechanism;

drive means for driving said cam unit;

a print ribbon mechanism for positioning said print ribbon between the character and the print medium in a print operation;

a correction ribbon mechanism for positioning said correction ribbon between the character and the print medium in an erasing operation; and control means for controlling said drive means to drive said cam unit at a print speed upon reception of a print command and to drive said cam unit by a predetermined amount in a first direction after said hammer is driven by said cam at said print speed, said control means controlling said drive means to drive said cam unit at an erasure speed higher than the print speed upon reception of an erasure command and to bring said cam unit to a halt without further driving said cam unit after said hammer is driven by said cam unit at said erasure speed.

2. The printing apparatus according to claim 1, wherein said control means controls said drive means to drive said cam unit at a speed lower than said print speed after said control means controls said drive means to drive said cam unit by the predetermined amount in said first direction to reduce strike noise in the print operation.

3. The printing apparatus according to claim 1, wherein said control means controls said drive means to drive said cam unit in said erasing operation with a kinetic energy sufficient to remove ink from said print medium.

4. The printing apparatus according to claim 1, wherein said control means controls said drive means to drive said cam unit in a second direction opposite to said first direction after said hammer is driven in each of said print operation and said erasing operation such that said cam unit and said hammer return to an original position.

5. The printing apparatus according to claim 1, wherein said cam unit comprises a print cam for driving said hammer, a ribbon supply cam for supplying said print ribbon and a lift cam for driving said correction ribbon mechanism.

6. The printing apparatus according to claim 5, wherein said ribbon supply cam and said lift cam form an integral unit.

7. The printing apparatus according to claim 5, wherein said lift cam comprises:

a reference cam having a uniform radius from a center of the lift cam;

a first inclined cam face extending continuously from said reference cam in a radius enlarging direction;

an outer cam face;

a second inclined cam face extending continuously from said first inclined cam face to said outer cam face, a guide wall extending from said radius enlarging direction from an end of said second inclined cam face; and a guide rib projecting from said guide wall along an outer periphery of said guide wall in a radius reducing direction, wherein said lift cam is engaged by a driven pin to position the correction ribbon.

8. The printing apparatus according to claim 5, wherein said print cam is substantially whirl-shaped.

9. A printing apparatus for applying an impact between a character and a print medium in response to an input command for one of printing the character and erasing a printed character, comprising:

a hammer which is driven to apply the impact between the character and the print medium;

a cam unit including hammer driving means for driving said hammer;

drive means for driving said cam unit; and control means for controlling said drive means to drive said cam unit at a print speed upon reception of a print command and to drive said cam unit by a predetermined amount in a first direction after said hammer is driven by said cam unit at said print speed, said control means controlling said drive means to drive said cam unit at an erasure speed higher than said print speed upon reception of an erasure command and to bring said cam unit to a halt without further driving said cam unit after said hammer is driven by said cam unit at said erasure speed.

10. The printing apparatus according to claim 9, wherein said control means controls said drive means to drive said cam unit at a speed lower than said print speed after said control means controls said drive means to drive said cam unit by the predetermined amount in said first direction to reduce strike noise in a print operation.

11. The printing apparatus according to claim 9, wherein said control means controls said drive means to drive said cam unit in an erasing operation with a kinetic energy sufficient to remove ink from said print medium.

12. The printing apparatus according to claim 9, wherein said control means controls said drive means to drive said cam unit in a second direction opposite to said first direction after said hammer is driven in each of a print operation and an erasing operation such that said cam unit and said hammer return to an original position.

13. The printing apparatus according to claim 9, wherein said cam unit comprises a print cam for driving said hammer, a ribbon supply cam for supplying said print ribbon and a lift cam for driving a correction ribbon mechanism.

14. The printing apparatus according to claim 13, wherein said ribbon supply cam and said lift cam form an integral unit.

15. The printing apparatus according to claim 13, wherein said lift cam comprises:

a reference cam having a uniform radius from a center of the lift cam;

a first inclined cam face extending continuously from said reference cam in a radius enlarging direction;

an outer cam face;

a second inclined cam face extending continuously from said first inclined cam face to said outer cam face, a guide wall extending from said radius enlarging direction from an end of said second inclined cam face; and a guide rib projecting from said guide wall along an outer periphery of said guide wall in a radius reducing direction, wherein said lift cam is engaged by a driven pin to position the correction ribbon.

16. The printing apparatus according to claim 13, wherein said print cam is substantially whirl-shaped.

* * * * *